United States Patent [19]

Rhoads

[11] 3,967,335

[45] July 6, 1976

[54] SUNBATHING AID

[76] Inventor: Lula L. Rhoads, Rte. 1, Slaton, Tex. 79364

[22] Filed: Mar. 14, 1974

[21] Appl. No.: 450,980

[52] U.S. Cl. ..... 5/338
[51] Int. Cl.[2] ..... A47G 9/00
[58] Field of Search ..... 5/338, 337, 345; D3/9.2

[56] References Cited

UNITED STATES PATENTS

| | | | |
|---|---|---|---|
| 1,548,728 | 8/1925 | Milam | 5/91 |
| 2,462,579 | 2/1949 | Warner | 5/345 |
| 2,933,738 | 4/1960 | Whelan | 5/338 |
| 3,378,862 | 4/1968 | Skinner | 5/338 |

OTHER PUBLICATIONS

House Beautiful, May 1970.

*Primary Examiner*—Werner H. Schroeder
*Assistant Examiner*—Doris L. Troutman
*Attorney, Agent, or Firm*—Wendell Coffee

[57] ABSTRACT

A cushion or pillow of foam rubber has two circular holes cut therein to receive the mammary glands of a woman lying thereon. The cushion is covered with terry cloth for sunbathing or covered with satin for sleeping. The cushion extends upward to form a support for the head.

4 Claims, 3 Drawing Figures

SUNBATHING AID

BACKGROUND OF THE INVENTION

1. Field of the Invention

This invention relates to pillows or cushions and more particularly to one to be used by a woman.

2. Description of the Prior Art

Other workers in the art have suggested making special cushions with holes therein for boney portions of the body to prevent bed ridden patients from developing bed sores at pressure points. These boney portions primarily are the shoulder blades, hip bones, portions of the spine, etc.

SUMMARY OF THE INVENTION

1. New and Different Function

Many women like to sun bathe. A favorite position is to lie on the stomach. If the woman sun bathes unclothed, the stomach position leaves the breasts unsupported and subjected to uncomfortable pressure when lying upon a flat surface.

I have discovered that a woman is much more comfortable when lying upon a surfact having a hole therein for each of the mammary glands.

Also, there are women who prefer to sleep upon their stomachs rather than their side or back. Again, many women experience uncomfortable pressure upon their mammary glands in such position. My invention solves this problem by providing a cushion or pillow which, when use, extends from about the waist of the user to above the head with two holes therein for the breasts and provides a support for the head. I have found that foam rubber covered with fabric makes a good cushion.

An object of this invention is to provide a cushion for a woman lying upon her stomach.

Further objects are to achieve the above with a device that is sturdy, compact, comfortable, durable, lightweight, simple, and soft, yet inexpensive and easy to manufacture, and maintain.

Other objects are to achieve the above with a method that is comfortable, inexpensive and does not require skilled people to fit and maintain.

The specific nature of the invention, as well as other objects, uses, and advantages thereof, will clearly appear from the following description and from the accompanying drawing, the different views of which are not to the same scale.

DESCRIPTION OF THE PREFERRED EMBODIMENTS

Figure 1:
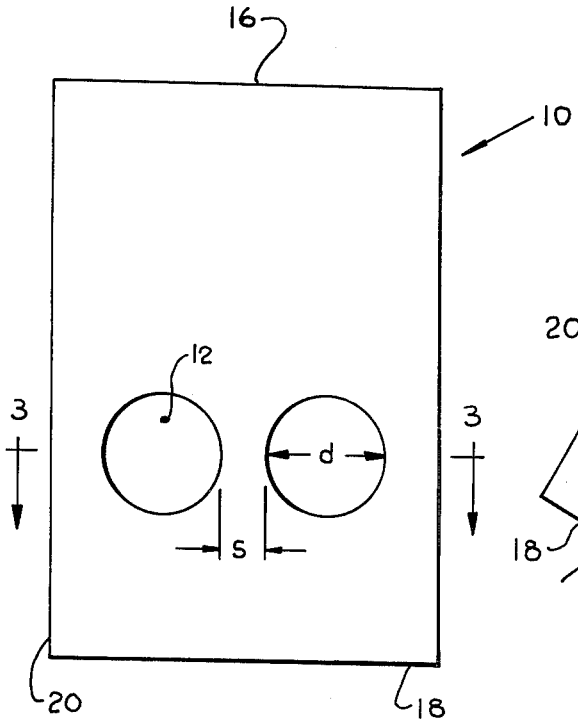
FIG. 1 is a plan view of a cushion according to this invention.
Figure 2:
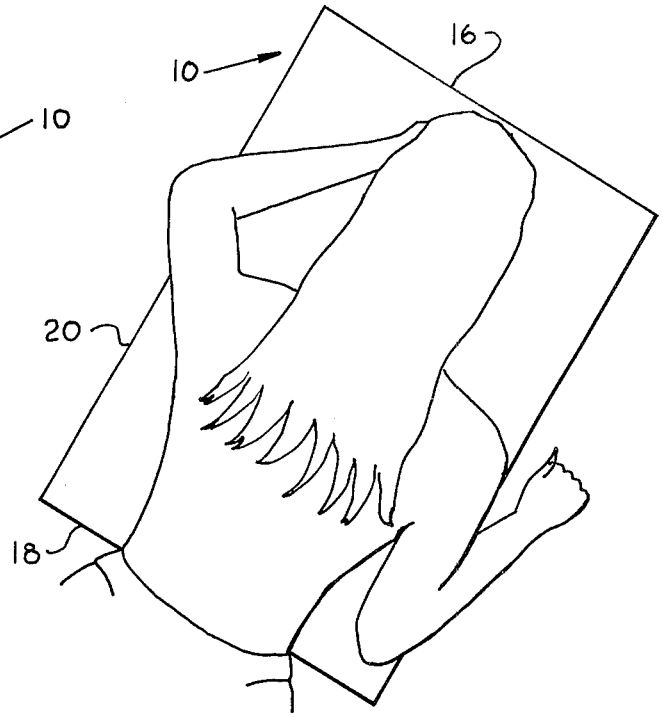
FIG. 2 is a perspective view of a cushion according to this invention in use.
Figure 3:
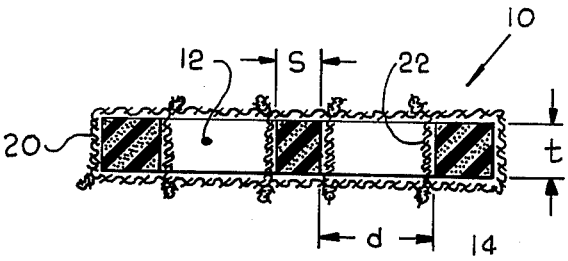
FIG. 3 is a sectional view taken substantially on line 3—3 of FIG. 1.

Referring more specifically to the drawing, cushion 10 is made from a thick sheet of foam rubber 18 inches wide by 27 inches long and by 2 inches thick *t*. In the thick sheet of foam rubber, I cut two circular holes 12, each 5 inches in diameter *d*. Holes 12 are placed with their centers 11 inches from the bottom 18 of the cushion and 7 inches on center from each other. I.e., the center of each hole is located 3½ inches from the center line of the cushion 10. Therefore, there is a 2 inch space *s* or 2 inches of foam rubber between the holes 12. Stated otherwise, the holes are spaced apart a distance *s* of 2 inches. Also, the distance from the top of the holes to the top of the cushion is about 13½ inches. I.e., the top of the holes 12 is approximately halfway between the top 16 and bottom 18 of the cushion 10.

The cushion 10 is covered with fabric 14. The preferred fabric for sun bathing is a single thickness of terry cloth measuring 31 × 40 inches plus allowance for seams. The fabric is folded around the pillow, having a seam at the top 16, bottom 18 and one side 20. The fabric has holes correlated to the holes in the foam rubber. The holes are each lined with a cylindrical piece of fabric 2 inches wide plus seam allowance on both sides and being 15½ inches in circumference. I have not experienced any irritation by the seams which surround the breasts while lying on the cushion.

Although I find foam rubber is the preferred material, other soft, resilient materials, from which pillows or cushions are made, are also suitable.

For women having larger breasts, I have found it desirable to make the cushion or pillow from a sheet of foam rubber which is 3 inches thick *t* and make the holes for the mammary glands 7 inches in diameter *d*. Also, I have found it desirable to make these holes with their centers about 11 inches from the bottom, but 9 inches on center. The spacing *s* between the holes 12 again being 2 inches. Stated otherwise, I have found that it is more desirable to provide at least a two-inch support between the mammary glands so this support fits against the breast bone (osseous sternum). I have found that with this spacing on the larger models, the head of the person rests nicely on the top portion of the pillow or cushion 10.

In conclusion, I have found it desirable to have the thickness *t* of the cushion about 40% of the diameter of the holes for the mammary glands. The spacing *s* between the holes 12 remains at 2 inches. There is no particular criticality about the entire length and width of the cushion. I.e., the pillow could be considerably longer and wider than the dimensions given. I do find it desirable to have the cushion of sufficient length so the head is supported; also, that the cushion extend around the mammary glands a sufficient distance to give support. I.e., the bosom is supported below the mammary glands by the rib cage, by the breast bone therebetween and by the upper rib cage and collar bone above the mammary glands, all resting upon the cushion. The mammary glands are not supported and thus eliminating any uncomfortable pressure upon the mammary glands as often experienced by a woman lying upon her stomach.

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. A cushion to support the bosom and head of a sunbathing woman lying upon her stomach comprising a. a thick sheet of soft, resilient material, b. said sheet of sufficient length to extend from the waist to above the head, c. two holes extending through the material to fit under the mammary glands, d. the top of the holes at about the mid-point of the length of the cushion, e. the thickness of the cushion being uniform and about 40% of the diameter of each hole, f. the distance between the holes being about 2 inches, and g. the cushion covered with terry cloth.

2. The invention as defined in claim 1 with an additional limitation of d. the cushion being of foam rubber.

3. The invention as defined in claim 2 with an additional limitation of j. the cushion being 18 × 27 × 2 inches and the holes being 5 inches in diameter.

4. The invention as defined in claim 2 with an additional limitation of j. the cushion being 18 × 27 × 3 inches and the holes being 7 inches in diameter.

* * * * *